United States Patent [19]

Jardine

[11] 4,184,657

[45] Jan. 22, 1980

[54] CLIMBING AIDS

[76] Inventor: Raymond D. Jardine, General Delivery, Yosemite National Park, Calif. 95389

[21] Appl. No.: 911,037

[22] Filed: May 30, 1978

[51] Int. Cl.[2] ..... A47G 29/00; B66D 1/00

[52] U.S. Cl. ..... 248/1; 254/135 R

[58] Field of Search ..... 182/230, 3; 294/86 R, 294/82 R, 89, 93, 95, 92; 254/135 R; 24/115 R, 114.5 R, 115 M; 248/1

[56] References Cited

U.S. PATENT DOCUMENTS

| | | | |
|---|---|---|---|
| 1,492,970 | 5/1924 | Elliott | 294/95 |
| 1,851,116 | 3/1932 | Spiro | 294/95 |
| 1,938,485 | 12/1933 | Cossor | 294/89 |
| 3,877,679 | 4/1975 | Lowe | 254/135 R |
| 3,946,975 | 3/1976 | Lyman | 248/1 |
| 3,948,485 | 4/1976 | Chouinard | 254/135 R |
| 4,082,241 | 4/1978 | Burkey | 248/1 |

*Primary Examiner*—Reinaldo P. Machado

*Attorney, Agent, or Firm*—Lowe, King, Price & Becker

[57] ABSTRACT

A climbing aid having a support bar, a spindle mounted on the support bar, two pairs of cam members pivotally mounted on the spindle adapted for opposite pivotal movement from a "closed" position to an "open" position, and spring members mounted on the spindle between each pair of cam members which act to apply force to each cam member to urge it into its open position. An operating bar is slidably mounted on the support bar and is connected to each cam member, there being at the opposite end of the support bar to the spindle an attachment point for a climbing rope. A downward force on the operating bar puts the cams into the "closed" position so that the climbing aid can be inserted into a crack formed in rock or the like. The bar is then released and the spring members force the cams into their "open" position to lock the climbing aid within the crack. The support bar may also include means to hold the operating bar in a position where the cam members are in the "closed" position.

10 Claims, 4 Drawing Figures

CLIMBING AIDS

This invention relates to climbing aids and is particularly though not necessarily exclusively concerned to climbing aids for rock climbing and the like.

When two or more climbers move over difficult or dangerous ground, it is highly advisable and common practice to utilise a rope to secure the climbers together and to anchor the rope in slidable manner to the face being climbed. It is obviously prudent to obtain a firm anchor to which the rope can be suitably secured. Such anchors can be nautral, i.e. rock spikes, flakes, chockstones jammed in cracks, natural rock threads and the like. With such anchors a separate loop of rope or webbing is attached to the natural anchor and to which the climbing rope is slidably secured. As an alternative to natural anchors, artificial anchors can be utilised. Thus, artificial chockstones or nuts are known of a variety of shapes and sizes and which are inserted into cracks or holes in the face being climbed where they can be made to jam. Pitons are also known, these being steel spike-like members of various shapes and sizes which can be hammered into cracks in the face. Yet again it is known to provide bolts, a modified form of piton and which are designed to be hammered into drilled holes in solid rock.

So far as natural anchors are concerned, these have no inherent disadvantage so long as the rock of the face being climbed is firm and not smooth, however at the start of a climb it is often apparent that there are an insufficient number of natural anchors existing over the whole face. Artificial chockstones provide an efficient anchor especially when placed in an uneven (ragged) crack, but placing the artificial chockstone in place tends to be somewhat difficult and/or time consuming, and even good placements can be dislodged by movement of the climbing rope. When all that is available, where an anchor is needed, is a smooth-sided, parallel-sided crack, placement of the chockstones is difficult both to make and to ensure it is secured. Both pitons and bolts again provide extremely efficient anchors, but with pitons being made from steel they tend to be heavy and can be difficult to place. Also removal of pitons can be extremely difficult and as they tend to scar the rock surface, many climbers are unwilling to use them. Similarly bolts take an appreciable length of time to place and as they form a permanent disfiguration of the rock face, there is again an unwillingness among the climbers to employ them except as a last resort.

According to the present invention, a climbing aid comprises a support bar, a spindle mounted on the support bar, at least two cam members pivotally mounted on the spindle and adapted for opposite pivotal movement from a "closed" position to an "open" position, means to apply a force to each cam member to urge it to its "open" position, an operating bar slidably mounted on the support bar and connected to each cam member, and there being at the opposite end of the support bar to the spindle an attachment point for a climbing rope. If required further means may be provided on the support bar to hold the operating bar in a position where the cam members are in the "closed" position.

Thus, two cam members may be provided at opposite ends of a spindle and lying to opposite sides of the support bar, with spring means provided on the spindle to provide a loading on each cam member to urge it to the "open" position. It is however preferable to mount the cam members in close proximity and to provide two pairs of cam members one pair to each side of the support bar, mutually spring loaded towards the "open" position by a torsion spring mounted on the spindle between the cam members of each pair, the arms of which are extended into engagement with the mutually inwardly facing edges of the cam members.

The operating bar may simply be a rod extending through a slot in the support bar, the slot extending longitudinally thereof, and if required there may be at the end of the slot remote from the cam members, a slot portion lying at an acute angle to the main direction of the slot and in which the rod can lie to hold the cam members in the "closed" position. The rod may be attached to each cam member by flexible connecting means, for example wire.

Preferably the cam surface is so shaped that when placed in a crack, the point of contact between a cam and a wall of a crack lies to the side of the spindle towards the open end of the crack, and a line through the point of contact and the axis of the spindle is constant for all degrees of "opening" of the cams, and at an angle of not less than 78° to the longitudinal axis of the support bar.

Thus, with the operating bar drawn along the slot in the support bar the cam members are drawn against the action of the spring means such that they lie in a "closed" position. With the cams inserted into an appropriate crack in a face being climbed, the operating bar is then released and when the spring means urge the cam member outwardly towards their "open" position such that the cam surfaces on the cam members contact the side of the crack. Once the cam surfaces are in contact with the sides of a crack whether it be a smooth parallel sided crack or otherwise the spring force on the cam members plus any longitudinal pull on the support bar urging it outwardly from the crack serves to increase the frictional force between the cam members and the walls of the crack. Therefore, in use, any loading on the support bar from a climbing rope preferably slidably secured to the attachment point at the end of the support bar cannot pull the climbing aid out of the slot, it merely jams the climbing aid in the crack to a greater or lesser degree dependant upon the force applied to the support bar.

Irrespective of the force to which the climbing aid has been jammed in a crack, removal of the climbing aid is an extremely simple exercise. By applying a force to the support bar inwardly of the crack, the frictional force between the spring loaded cam members and the walls of the crack is released, and when the operating bar can be pulled along the slot in the support bar to pivot the cam members about the spindle against the spring loading to the "closed" position to release them completely from the walls of the crack.

One embodiment of the invention will now be described with reference to the accompanying drawings, in which.

Figure 1:
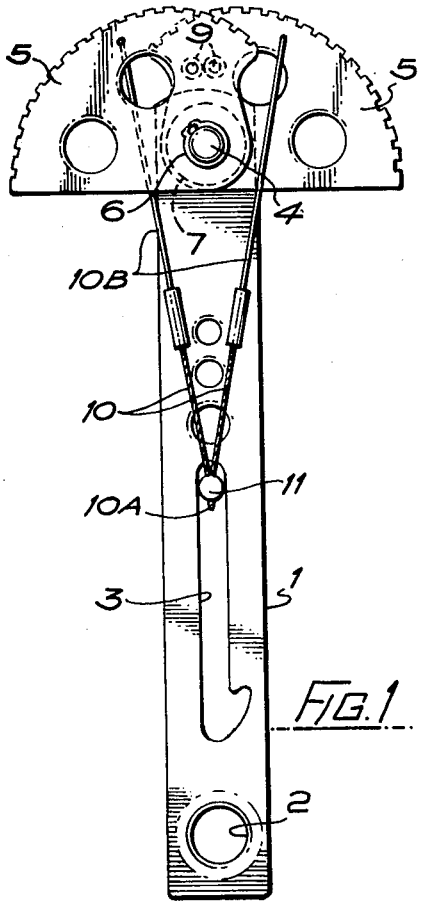
FIG. 1 is a front elevation of a climbing aid according to the invention.
Figure 4:
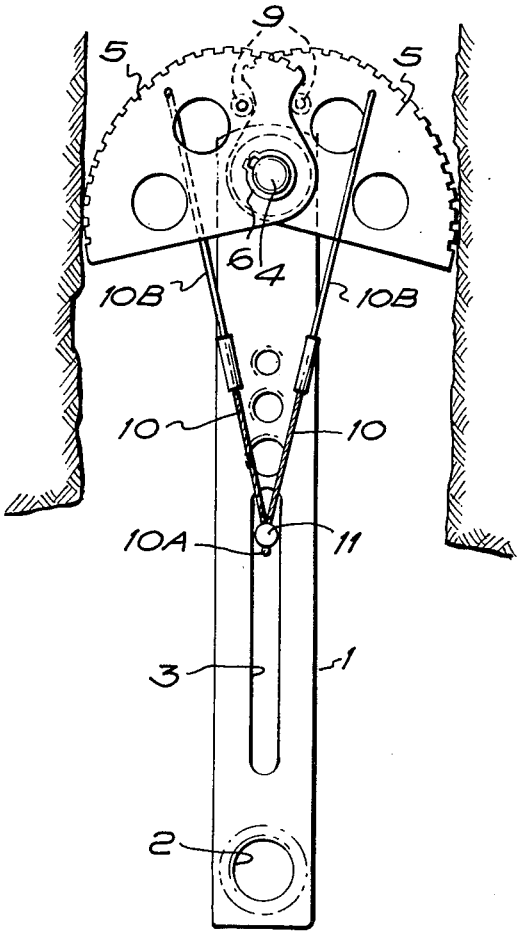

FIG. 4 corresponds to FIG. 1 but shows the climbing aid without the auxiliary slot portion lying at an acute angle to the main direction of the slot and with the climbing aid actually inserted in a crack.

In the drawings, a climbing aid is formed by a support bar 1 having an attachment point 2 for a climbing rope, and a longitudinal slot 3. At the opposite end of the bar 1 from the attachment point 2 a spindle 4 is located in a transverse hole in the support bar, there being pivotally mounted on the spindle 4 two pairs of cam members 5, one pair lying to each side of the support bar, with the cams secured to the spindle by spring clips 6. The inner cam of each pair is spaced from the support bar by spacers 7 of low friction material.

Figure 2:
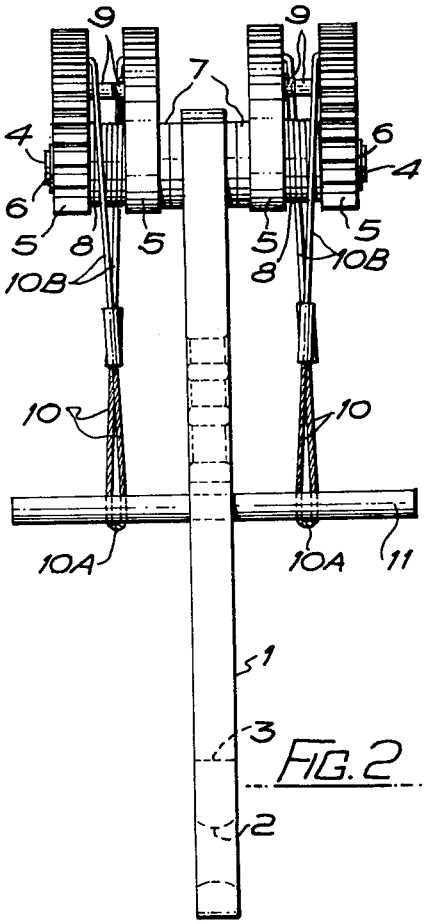
FIG. 2 is a side elevation of the climbing aid of FIG. 1.
Figure 3:
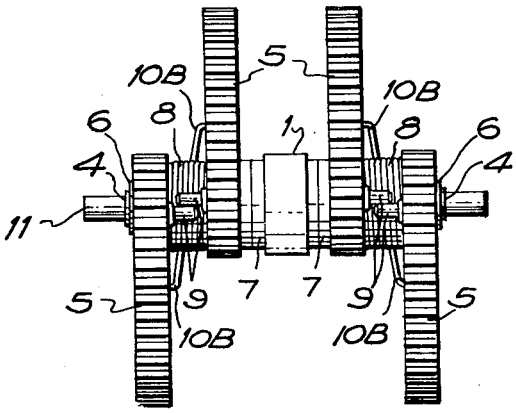
FIG. 3 is a plan view of the climbing aid of FIG. 1.

Between the cams of each pair, a coil spring 8 is provided surrounding the spindle 4 and with the free ends of the coil spring engaging round abutments 9 provided on the cam side walls, the spring urge being such as to urge the cams towards their open position shown in FIGS. 1 to 3. The abutments 9 also serve as stop means to restrict the "opening" movement of the cams.

Secured to the inside face of the cam 5 of each pair is an operating wire 10 which extends to and is secured to an operating bar 11 passing through the slot 3 in the support bar. Preferably, as shown, each operating wire is a flexible loop 10A passing through spaced holes in the operating bar, joined to each cam 5 by a more rigid wire section 10B.

In use, the operating bar 11 is drawn along the slot 3 to pivot the cams 5 of each pair on the spindle 4 against the action of the respective coil spring 8 and put the cams in a "closed" condition when the climbing aid can be introduced into a crack. On the release of the operating bar, the coil springs 8 urge the cams towards their "open" position and hence urge the cam surfaces 12 into contact with the walls of the crack as is shown in FIG. 4. With a climbing rope suitably secured to the attachment point 2, any loading of the climbing aid in a direction tending to pull the climbing aid out of the crack merely serves to increase the jamming force between the cams 5 and the walls of the crack. To release the climbing aid, a small loading on the support bar inwardly of the crack is sufficient to release the frictional force between the cams 5 and the walls of the crack, and when the operating bar 11 can be pulled rearwardly of the slot 3 to pivot the cams to their "closed" position and allows the climbing aid to be withdrawn.

The cam surfaces of the cams 5 are so shaped that no matter what the width of crack, within of coarse, the maximum and minimum crack widths for which the climbing aid is designed, the contact point on the cam surfaces with the walls of the crack has a constant angular relationship with respect to the longitudinal axis of the support bar. Thus, the line of action through the contact point and the axis of the spindle should always be less than 78° to the longitudinal axis of the support bar. This ensures that the cams can never slip out of the crack so long as the crack width is within the limits for which the climbing aid is designed. The particular angle can be designed to suit different rock materials, but an angle of approximately 76° would allow the climbing aid to be used on all normal rock structures that a climber would reasonably expect to encounter.

The invention therefore provides an extremely simple and highly efficient climbing aid which does not rely on the face being climbed necessarily having rough sided cracks, and avoids damage or scaring of that face.

What I claim is:

1. A climbing aid comprising a support bar, a spindle mounted on the support bar, at least two cam members pivotally mounted on the spindle and adapted for opposite pivotal movement from a "closed" position to an "open" position, means to apply a force to each cam member to urge it to its "open" position, an operating bar slidably mounted on the support bar and connected to each cam member and there being at the opposite end of the support bar to the spindle an attachment point for a climbing rope.

2. A climbing aid as in claim 1, wherein further means are provided on the support bar to hold the operating bar in a position where the cam members are in the "closed" position.

3. A climbing aid as in claim 1 or claim 2, wherein two cam members are provided at opposite ends of a spindle and lying to opposite sides of the support bar, with spring means provided on the spindle to provide a loading on each cam member to urge it to the "open" position.

4. A climbing aid as in claim 1 or claim 2, wherein two pairs of cam members are provided, one pair to each side of the support bar mutually spring loaded towards the "open" position by a coil spring mounted on the spindle between the cam members of each pair, the arms of which are extended into engagement with the mutually inwardly facing edges of the cam members.

5. A climbing aid as in any of claim 1, wherein the operating bar is a rod extending through a slot in the support bar, the slot extending longitudinally thereof.

6. A climbing aid as in claim 5, wherein there is, at the end of the slot remote from the cam members, a slot portion lying at an acute angle to the main direction of the slot and in which the rod can lie to hold the cam members in the "closed" position.

7. A climbing aid as in claim 6, wherein the rod is attached to each cam member by flexible connecting means, for example, wire.

8. A climbing aid as in any of claim 1, wherein the cam surface of each cam is so shaped that when placed in a crack, the point of contact between a cam and a wall of a crack lies to the side of the spindle towards the open end of the crack, and a line through the point of contact and the axis of the spindle is constant for all degrees of "opening" of the cams, and at an angle of not greater than 78° to the longitudinal axis of the support bar.

9. A climbing aid as in claim 8, wherein the angle is 76°.

10. A climbing aid comprising a support bar, a spindle mounted on the support bar, two pairs of cam members pivotally mounted on the spindle and adapted for opposite pivotal movement from a "closed" position to an "open" position, one pair of the cam members on each side of the support bar being mutually spring loaded towards the "open" position by a coil spring mounted on the spindle between the cam members of each pair, an operating bar slidably mounted on the support bar and connected to each cam member, means provided on the support bar to hold the operating bar in a position where the cam members are in the "closed" position, and an attachment point for a climbing rope formed at the opposite end of the support bar to the spindle.

* * * * *

UNITED STATES PATENT OFFICE

CERTIFICATE OF CORRECTION

PATENT NO. : 4,184,657

DATED : January 22, 1980

INVENTOR(S) : Raymond D. Jardine

It is certified that error appears in the above-identified patent and that said Letters Patent are hereby corrected as shown below:

ON TITLE PAGE

Insert:--Foreign Application Priority Data

June 4, 1977 [GB] United Kingdom....23854/77--

Signed and Sealed this

*Fifth* Day of *August 1980*

[SEAL]

*Attest:*

SIDNEY A. DIAMOND

*Attesting Officer*

*Commissioner of Patents and Trademarks*